US005191842A

United States Patent [19]

Tinkler

[11] Patent Number: 5,191,842

[45] Date of Patent: Mar. 9, 1993

[54] MODULAR STRUCTURE FOR CONVERTING RAIL CARS FOR CARRYING BOTH COILED AND PLATE MATERIALS DIRECTLY ON LONGITUDINAL RAILS AND CROSS MEMBERS

[75] Inventor: Robert W. Tinkler, Colmar, Pa.

[73] Assignee: Consolidated Rail Corporation, Philadelphia, Pa.

[21] Appl. No.: 770,980

[22] Filed: Oct. 1, 1991

[51] Int. Cl.[5] ..... B61D 3/16

[52] U.S. Cl. ..... 105/355; 105/370; 410/47; 410/54

[58] Field of Search ..... 105/238.1, 243, 355, 105/370, 371, 375; 410/32, 36, 42, 47, 44, 54, 129, 130

[56] References Cited

U.S. PATENT DOCUMENTS

| | | | |
|---|---|---|---|
| 2,971,795 | 2/1961 | Winski | 410/42 |
| 3,581,674 | 6/1971 | O'Leary | 410/49 X |
| 3,754,516 | 8/1973 | Van Gompel | 410/47 |
| 4,082,357 | 4/1978 | Schmidt et al. | 298/27 |
| 4,221,427 | 9/1980 | Sentle, Jr. et al. | 105/243 X |
| 4,360,298 | 11/1982 | Fischer et al. | 410/32 |
| 4,484,527 | 11/1984 | O'Hara | 105/247 |
| 4,492,499 | 1/1985 | Gasper | 410/32 |
| 4,696,088 | 9/1987 | Miller | 29/401.1 |
| 4,732,528 | 3/1988 | Good | 410/49 X |
| 4,893,568 | 1/1990 | Adams | 105/416 |
| 5,048,885 | 9/1991 | Bomar | 410/49 X |

FOREIGN PATENT DOCUMENTS

| | | | |
|---|---|---|---|
| 3637127 | 8/1987 | Fed. Rep. of Germany | 410/32 |
| 2052416 | 9/1980 | United Kingdom | 410/49 |

*Primary Examiner*—Robert J. Oberleitner
*Assistant Examiner*—S. Joseph Morano
*Attorney, Agent, or Firm*—Woodcock, Washburn, Kurtz, Mackiewicz & Norris

[57] ABSTRACT

A conversion structure for converting a gondola railcar or similar apparatus for transporting materials to transport cargo in the form of discrete plates or in the form of discrete cylindrical units, such as coils of steel. The apparatus disclosed comprises two longitudinally extending rails connected by a series of cross members. At either longitudinal end of the rails, the cross members are replaced by bulkheads which prevent the discrete cargo from sliding beyond the end of the rails. Preferably, the conversion structure is removable in order to permit the gondola car to be reconverted for hauling bulk cargo. In a preferred embodiment, stacking projections are provided on the conversion structure so that when they are removed, they may be stacked atop one another for storage. Improved methods of alternately transporting bulk, plate and cylindrical cargo are also disclosed.

20 Claims, 5 Drawing Sheets

MODULAR STRUCTURE FOR CONVERTING RAIL CARS FOR CARRYING BOTH COILED AND PLATE MATERIALS DIRECTLY ON LONGITUDINAL RAILS AND CROSS MEMBERS

The present invention relates to apparatus for transporting materials and more particularly relate to apparatus convertible for hauling goods of distinctly different forms.

BACKGROUND OF THE INVENTION

Convertible vehicle bodies for railroad cars have been used to convert between hauling loose bulk cargo such as grain and discrete cargo. These convertible bodies typically provide slope sheets that alternatively form continuations of loose bulk cargo hoppers or stow to leave the length of the vehicle body free for transporting discrete cargo. Examples of such devices are disclosed in U.S. Pat. No. 4,484,527—O'Hara and U.S. Pat. No. 4,082,357—Schmidt et al.

Also, due to the changing demands of the transportation industry a situation arises where certain vehicle body styles are more frequently needed than in the past and other vehicle body styles fall into disfavor. This can lead to certain less popular vehicle body styles being permanently converted to another style that is experiencing a greater demand. Examples of such permanent conversions in the context of hopper type railcars are disclosed in U.S. Pat. No. 4,696,088—Miller and U.S. Pat. No. 4,893,568—Adams. Of course, once such a conversion is undertaken, it is difficult to re-convert the vehicle to its original configuration.

A major user of railway transport in North America is the steel industry. Due to the existing infrastructure of raw material storage facilities, railways, steel mills and finishing plants it is economically feasible to haul tons of cargo hundreds of miles from one processing step to another. For example, plate steel is normally shipped in the form of slab breakdowns on flatbed railcars or gondolas to finishing plants to be processed into coils. The coils are then shipped elsewhere using specialized railcars that facilitate loading and unloading of the coils on the railcars. However, the situation arises wherein the gondolas that had been used to haul slab breakdowns must be hauled empty to the mills from which they came. Similarly, the specialized coil cars must be hauled back empty to the coiling mill from the site where the coils are off loaded. Additionally, at certain periods in time, there is little demand for coil steel and the specialized coil cars sit idle in oversupply.

It would be desirable to improve the utilization of specialized coil cars and gondola cars. Accordingly, it is an object of the present invention to provide a railcar design capable of hauling both slab breakdowns and coils in a manner facilitating both the loading and off loading of both forms of cargo.

SUMMARY OF THE INVENTION

Accordingly, it has now been found that a structure for retaining materials within an apparatus for transporting goods such as a railcar can be constructed and adapted to retain materials in both plate form and cylindrical form. Such an apparatus would take the form of a conversion structure which comprises a pair of longitudinally extending rails for retaining the materials being transported, the rails being connected by a plurality of cross members preferably extending laterally beyond the rails which also act to retain the materials. Bulkheads are provided at either end of the structure for preventing materials from shifting longitudinally beyond the ends of the rails. In a preferred embodiment, the lateral spacing between the rails is chosen to permit the cylindrical form of materials to be retained by two points of contact with the rail. Also, in a preferred embodiment, the conversion structure is removably retained within the apparatus for transporting materials by a plurality of fasteners that extend through slotted holes into an apparatus for transporting materials such as a railcar. Preferably, the cross members are spaced along the rails and comprise a built-up section comprising at least a T-beam section, a rectangular tube section and a base plate section. In a preferred embodiment, the conversion structure further comprises means for securely stacking the conversion structures atop one another.

The conversion structure also permits improved methods of transporting bulk cargo, plate cargo and cylindrical cargo using the same railcar. By installing the conversion structure, either plate cargo or cylindrical cargo can be alternately hauled using a gondola car. By removing the conversion structure bulk cargo can be handled in the same railcar. Preferably, the conversion structure is provided with means for stacking the conversion structures atop one another, and the methods of transporting materials also include the step of stacking the conversion structures for storage.

DETAILED DESCRIPTION OF THE PREFERRED EMBODIMENTS

Figure 1:
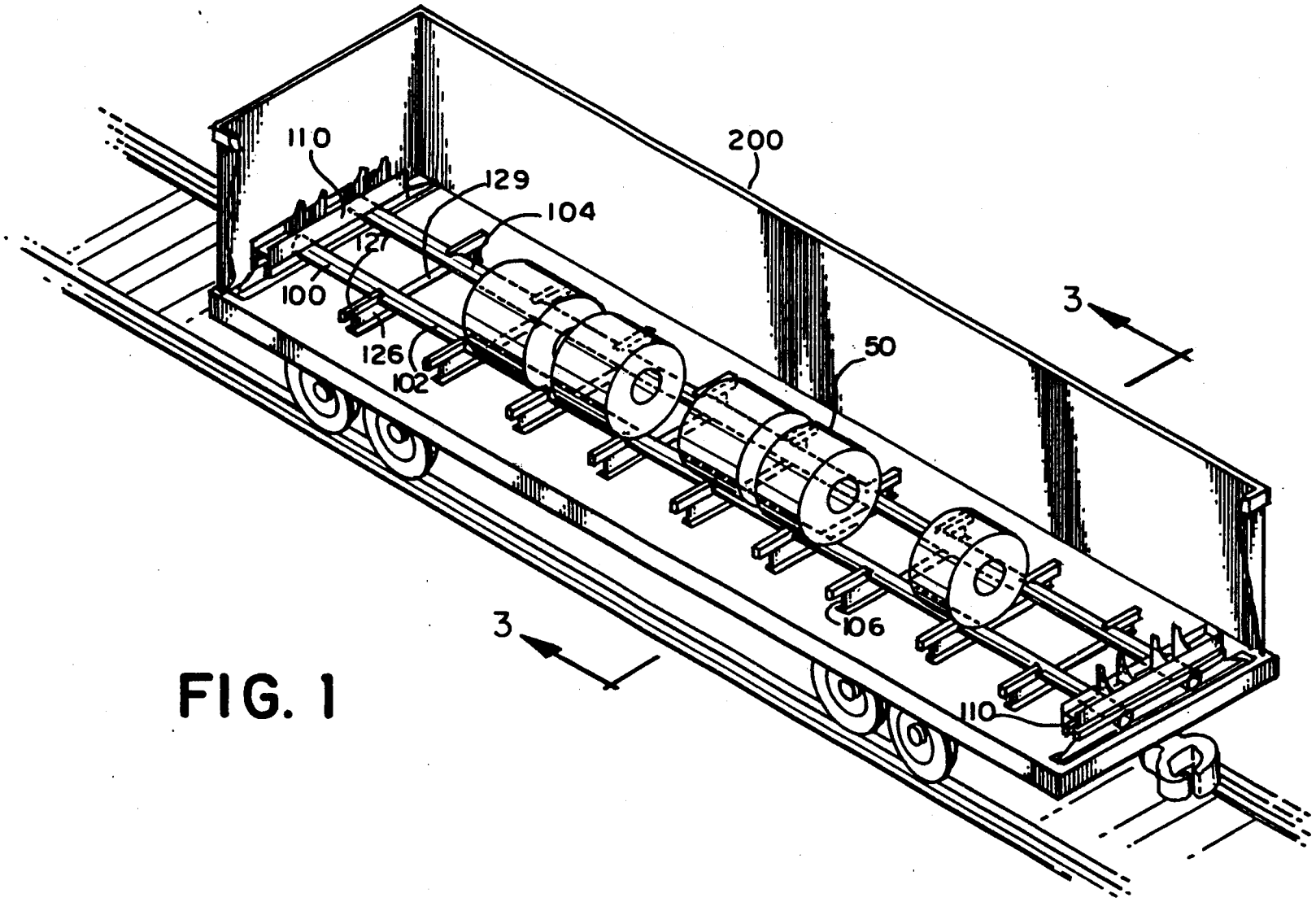
FIG. 1 is a perspective view of an open gondola car, partially broken away, illustrating the apparatus of the present invention being used to transport coils of steel or similar cargo.

Referring to FIG. 1, there is shown a partially broken away view of a railcar 200 of a typical open style such as a gondola car. Disposed within the railcar 200 is a conversion structure 100 made in accordance with the present invention. As shown, the conversion structure 100 is comprised of a pair of longitudinally extending rails 102,104 that are spaced apart so as to effectively retain certain types of materials such as the coils 50 illustrated. It can be seen that the coils 50 rest upon the rails 102,104 in a secure manner yet can be easily loaded and off loaded since they are not resting on the flat bottom of the railcar 200. A series of cross members 106 extend along and join the rails 102,104 to create a "ladder" structure. However, the ends of the cross members 106 preferably extend laterally beyond the rails 102,104.

At either end of the conversion structure 100 a bulkhead 110 connects the ends of the rails 102,104. One of the functions of the bulkheads 110 serve is to prevent damage to the railcar 200 should the coils or other cargo move longitudinally upon sudden acceleration or deceleration of the railcar 200.

In the preferred embodiment illustrated in FIG. 1, it can be seen that the cross members 106 are most preferably a built up welded section comprised of a "Tee" section 126 cut to fit around the outer circumference of the rails 102,104. A length of rectangular tubing 127 similarly cut to conform to a section of the perimeter of the rails 102,104 is placed atop the "Tee" section 126. Each rail 102,104 and its built up extension section are joined by at least a base plate 129 that extends beneath both rails 102,104 as well as beneath the respective "Tee" sections 126 extending from them to form the cross members 106. Further details of the construction of the preferred embodiment of the apparatus of the present invention are set forth below.

Figure 2:
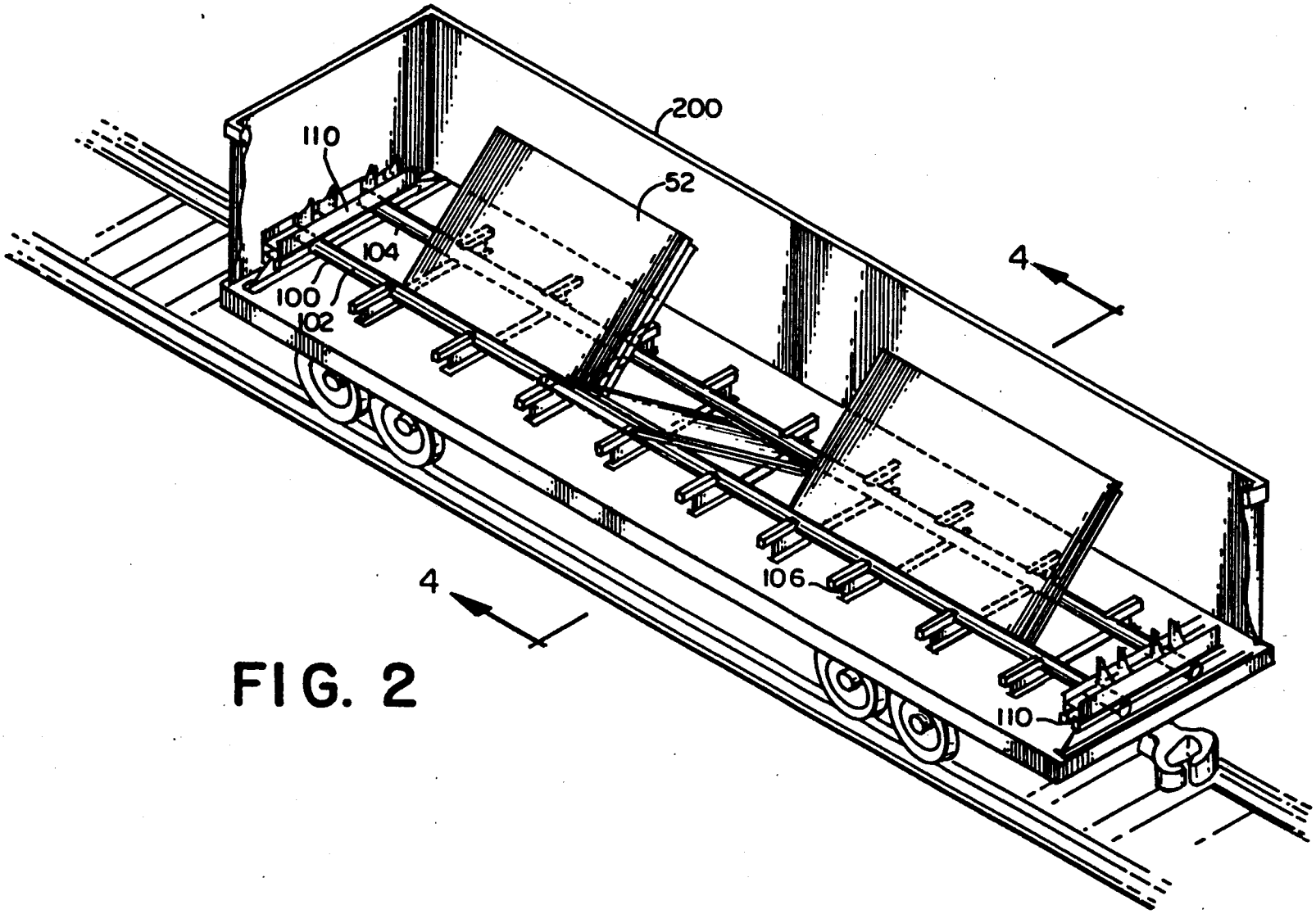
FIG. 2 is a perspective view similar to FIG. 1 showing the transportation of slab breakdowns of steel or similar cargo.
Figure 4:
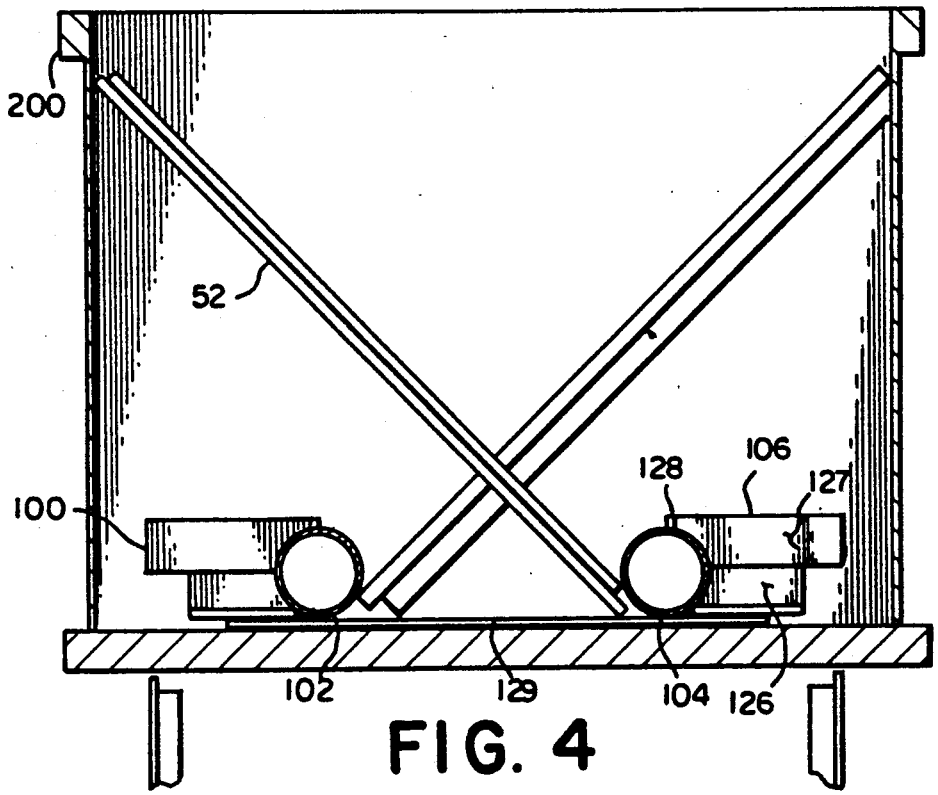
FIG. 4 is a cross-sectional elevation view similar to FIG. 3, but taken along line 4—4 of FIG. 2.

As illustrated in FIG. 2, the conversion structure 100 also permits materials in plate form such as slab breakdowns 52 to be hauled in an open gondola-type railcar 200. The slab breakdowns 52 are positioned so that they rest across one or more of the cross members 106 with one edge lodged against one of the rails 102,104. As illustrated in FIG. 4, the tops of the slab breakdowns 52 most preferably rest against the side of the railcar 100; however, in some loading situations the cargo may extend beyond the uppermost extent of the side. It should also be noted that it is preferred to alternate the direction in which the slab breakdowns 52 or other cargo are oriented. The staggered arrangement illustrated in FIG. 2 permits easier loading and unloading of the railcar 200.

Figure 3:
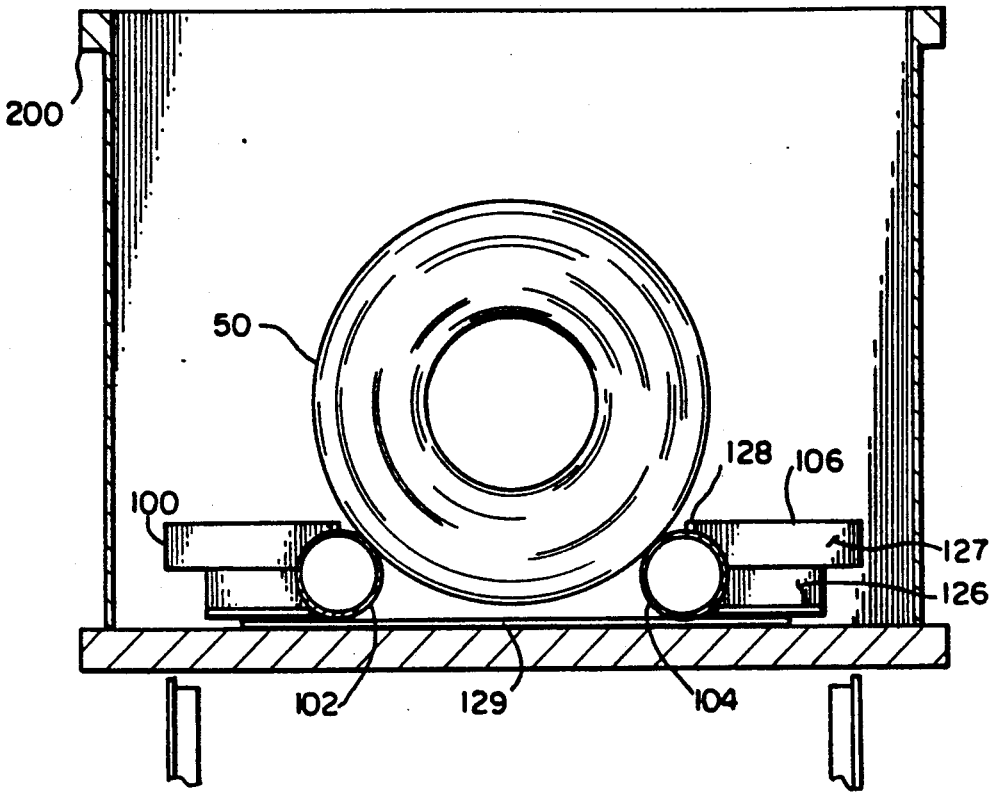
FIG. 3 is a cross-sectional elevation view of a railcar made in accordance with the present invention taken along line 3—3 of FIG. 1.

Thus, as seen in FIG. 3, the conversion structure 100 of the present invention supports cargo in the form of a coil 50 by providing rails 102,104 upon which the coil rests, suspended above the floor of the vehicle body to ease loading and unloading. The same conversion structure 100 also provides secure restraint for plate-form cargo such as slab breakdowns, as illustrated in FIG. 4. It can also be seen that the rails 102,104 preferably rest atop a base plate 129 that extends between them and beneath the "Tee" sections 126 and tubing sections 127 that form lateral extensions from each of the rails. Also visible in FIGS. 3 and 4 are the slab guides 128 affixed atop the rails 102,104 near the juncture with the tubing sections 127. In a most preferred embodiment of the present invention the conversion structure 100 is removably attached to the vehicle body 200 by a series of threaded fasteners that extend through slotted holes. The slotted holes permit a small degree of movement and flexure in the conversion structure 100.

Figure 5:
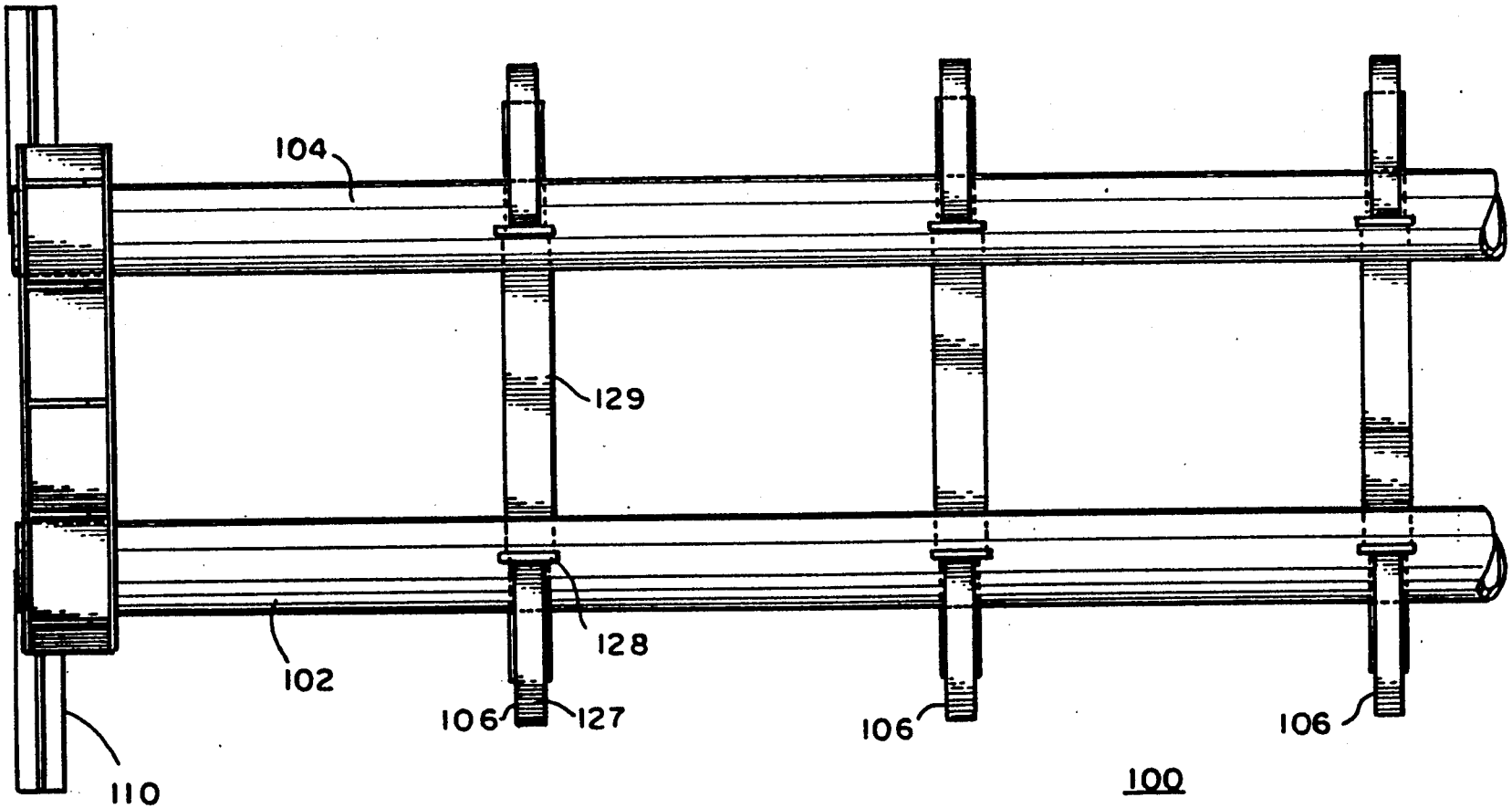
FIG. 5 is a partial plan view of the modular conversion apparatus of the present invention.

Referring now to FIG. 5, a top plan view of a portion of the conversion structure 100 of the present invention is illustrated. In this view, the construction of the rails 102;104 and cross members 106 can be seen, along with that of the bulkhead 110. In a preferred embodiment of the conversion structure 100 of the present invention, the spacing between the cross members 106 and between the cross members 106 and the bulkhead 110 is about 60.0 inches (154.2 cm). The spacing between the centerlines of the rails 102,104 is most preferably about 48.0 inches (121.9 cm). These dimensions have been found to provide useful capacity and flexibility for handling the coils 50 and slab breakdowns 52 discussed above when the conversion structure 100 of the present invention is installed in a conventional gondola railcar 200. Those of ordinary skill will realize that depending upon the size of the vehicle body and the typical dimensions of the cargo carried, the dimensions of the conversion structure 100 may vary widely from these preferred dimensions. As seen in FIG. 5, in a preferred embodiment of the conversion structure 100 the base plate 129 extends between the lateral extension portions formed by the tubing section 127, slab guide 128 and "Tee" section (not visible).

Figure 6:
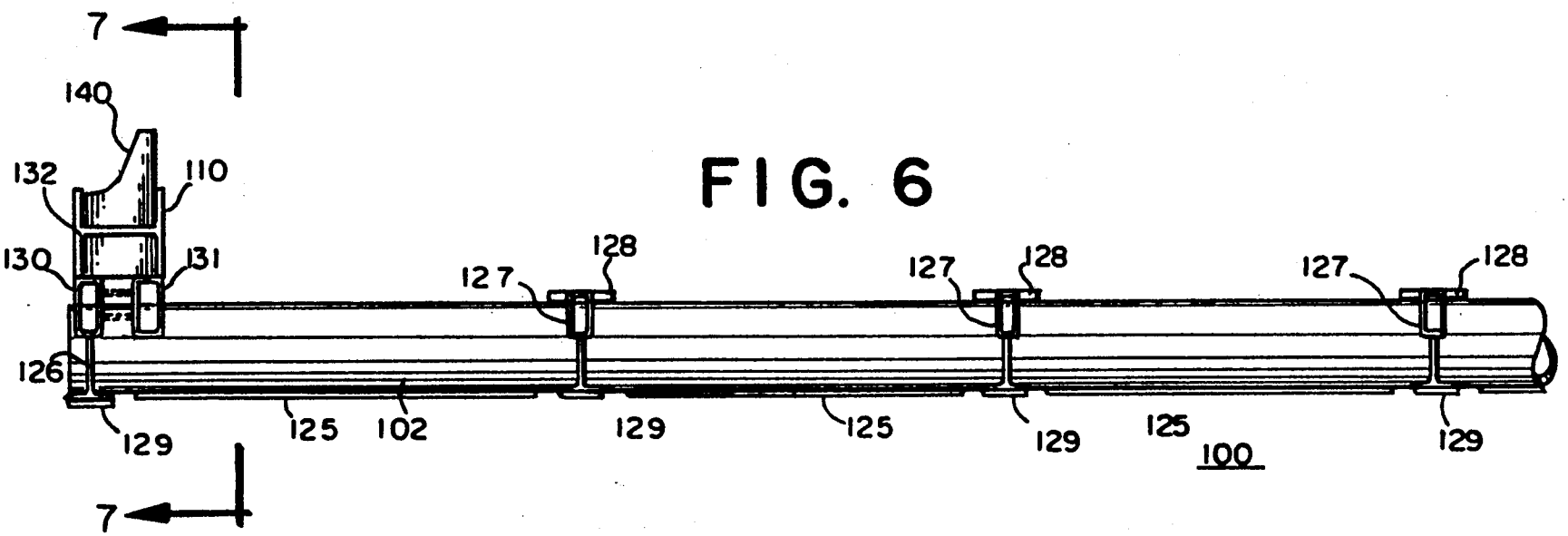
FIG. 6 is a partial side elevation view of the apparatus depicted in FIG. 5.

A side view of the portion of the conversion structure illustrated in FIG. 5 is shown in FIG. 6. In FIG. 6, it can again be seen that in a preferred embodiment of the conversion structure 100 of the present invention the cross members 106 are formed from a built-up section comprising a "Tee" section 126 that is welded to a rectangular tube section 127. The slab guides 128 are then welded to the top of the tube section 127. Also visible in FIG. 6 are bearing runners 125 that comprise long narrow plates affixed along the length of the rails 102,104. The bearing runners 125 ensure that the rails 102,104 do not deform due to the weight of cargo placed between the sections supported by the base plates 129. A further detail of the construction of the bulkheads 110 also visible in FIG. 6 is that the bulkheads 110 preferably comprise a built-up section similar to that of the cross members 106. However, in this instance a second rectangular tubing section 131 is placed adjacent the first rectangular tubing section 130 and an "I-beam" section 132 that is most preferably a "W" type section is attached to the top of the rectangular tubing sections 130,131.

Figure 7:
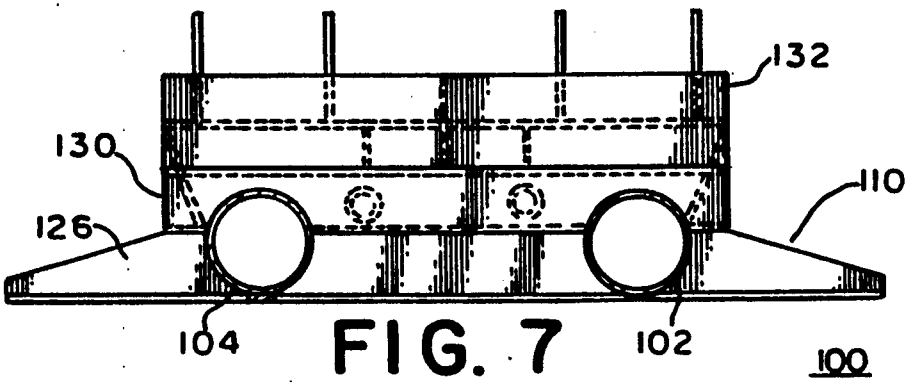
FIG. 7 is a cross-sectional elevation view of the apparatus of the present invention taken along line 7—7 of FIG. 6.

As noted above, in a preferred embodiment the conversion structure 100 may be readily removed from the vehicle body 200 to which it is attached. Thus, in the case of the preferred embodiment illustrated, when the conversion structure 100 is removed, the gondola car 200 may be used for any of the types of hauling with which it is normally associated. The removed conversion structure can be stored until needed to fulfill the demand for certain types of cargo hauling. Thus, one of the important features of the present invention also visible in FIG. 6 is the stacking projection 140 that allows several of the conversion structures 100 of the present invention to be safely and securely stacked atop one another to minimize the required storage space. The stacking projections 140 are designed to engage the bottom of a conversion structure 100 and store it in a position spaced apart from any adjacent conversion structures 100 in order to permit access by the material handling equipment that inserts and removes the conversion structures 100. An end view of a bulkhead 110 shown in FIG. 7 illustrates that four stacking projections 140 are preferably spaced along the upper edge of the bulkhead 110. This spacing also facilitates the use of the above-mentioned material handling equipment.

Although certain embodiments of the present invention have been described above with particularity, the present invention is not meant to be limited to such preferred embodiments. Upon review of this specification, those of ordinary skill will realize that numerous adaptations and modifications of the present invention can be readily made. Accordingly, reference should be had to the appended claims in order to determine the scope of the present invention.

What is claimed is:

1. Apparatus for transporting materials comprising: a cargo area and a conversion structure for retaining materials, the conversion structure disposed within the cargo area, the conversion structure comprising:

a pair of longitudinal extending rails for directly supporting and retaining materials, wherein the materials are in direct contact with the rails;

a plurality of cross members extending between the rails, the cross members also for retaining the materials, wherein the materials are in direct contact with the cross members; and bulkhead means disposed laterally across the rails at ends thereof for preventing the materials from shifting longitudinally beyond the rails.

2. The apparatus of claim 1, wherein the conversion structure is removable and the bulkhead means comprise means for securely stacking the conversion structure atop another conversion structure.

3. The apparatus of claim 2 wherein the conversion structure is retained within the cargo area by a plurality of fasteners extending through slotted holes that extend through the cargo area.

4. The apparatus of claim 1, wherein the apparatus for transporting materials is a railway car.

5. The apparatus of claim 1, wherein the materials are of sheet form and of cylindrical form.

6. The apparatus of claim 5, wherein the lateral spacing between the rails is chosen to permit the cylindrical form of material to be retained at two points of contact within the rails.

7. The apparatus of claim 6, wherein the lateral spacing between the rails is about 48.0 inches (121.9 cm).

8. The apparatus of claim 5 wherein the cross members are substantially evenly spaced along the rails and between the bulkheads.

9. The apparatus of claim 8 wherein the spacing between the cross members is about 60.0 inches (154.2 cm).

10. The apparatus of claim 1 wherein the rails are tubular in cross-section and the cross-members comprise a built-up section comprising at least a T-beam section, a rectangular tube section and a base plate section.

11. A conversion structure for retaining materials comprising:

a pair of longitudinally extending rails for directly supporting and retaining materials, wherein the materials are in direct contact with the rails;

a plurality of cross members extending between the rails, the cross members also for retaining the materials, wherein the materials are in direct contact with the cross members; and bulkhead means disposed laterally across the ends of the rails for preventing the materials from shifting longitudinally beyond the rails.

12. The conversion structure of claim 11, wherein the bulkhead means comprise means for securely stacking the conversion structure atop another conversion structure.

13. The conversion structure of claim 11, wherein the materials are of plate form and of cylindrical form.

14. The conversion structure of claim 13, wherein the lateral spacing between the rails is chosen to permit the cylindrical form of material to be retained at two points of contact with the rails.

15. The conversion structure of claim 14, wherein the lateral spacing between the rails is about 48.0 inches (121.9 cm).

16. The conversion structure of claim 13, wherein the cross members are substantially evenly spaced along the rails and between the bulkheads.

17. The conversion structure of claim 16 wherein the spacing between the cross members about 60.0 inches (154.2 cm).

18. The conversion structure of claim 11 wherein the rails are tubular in cross-section and the cross-members comprise a built-up section comprising at least a T-beam section, a rectangular tube section and a base plate section.

19. A method of alternately transporting bulk cargo, plate cargo and cylindrical cargo in an open gondola railcar comprising the steps of:

providing a removable conversion structure comprised of two rails connected by a plurality of cross-members;

installing the conversion structure;

transporting plate cargo by placing an edge of each plate against one of the rails of the conversion structure;

transporting cylindrical cargo by placing the cargo between the rails whereby the outer circumference of the cylindrical cargo contacts the rails at two points;

removing the conversion structure; and hauling bulk cargo in the railcar.

20. The method of claim 19, further comprising the steps of:

storing the conversion structure after removal by placing it on top of another conversion structure.

* * * * *